US009187281B2

(12) United States Patent
Chang et al.

(10) Patent No.: US 9,187,281 B2
(45) Date of Patent: Nov. 17, 2015

(54) PAPER ROLL DEVICE CAPABLE OF DETECTING AN OPEN/CLOSED STATE OF A COVER

(71) Applicants: IEI Integration Corp., New Taipei (TW); Armorlink SH Corp., Shang-Hai (CN)

(72) Inventors: Yu-Tsung Chang, New Taipei (TW); Yu-Hsiang Wang, New Taipei (TW)

(73) Assignees: IEI Integration Corp., Xizhi Dist., New Taipei (TW); Armorlink SH Corp., Min-Sing-Sin-Jhuang Industrial District, Shang-Hai (CN)

( * ) Notice: Subject to any disclaimer, the term of this patent is extended or adjusted under 35 U.S.C. 154(b) by 120 days.

(21) Appl. No.: 14/089,765

(22) Filed: Nov. 26, 2013

(65) Prior Publication Data

US 2015/0069171 A1 Mar. 12, 2015

(30) Foreign Application Priority Data

Sep. 11, 2013 (CN) ..... 2013 1 0414150

(51) Int. Cl.
*B65H 26/00* (2006.01)
*B65H 43/08* (2006.01)

(52) U.S. Cl.
CPC ..... *B65H 26/00* (2013.01); *B65H 43/08* (2013.01)

(58) Field of Classification Search
CPC ..... B65H 26/00; B65H 43/08
USPC ..... 242/563, 534, 413.2, 421.2–421.3
See application file for complete search history.

(56) References Cited

U.S. PATENT DOCUMENTS

| | | | | |
|---|---|---|---|---|
| 4,019,618 | A * | 4/1977 | Busch | 400/219.3 |
| 5,758,982 | A * | 6/1998 | Yoshida et al. | 400/708 |
| 6,698,959 | B2 * | 3/2004 | Kaya | 400/613 |
| 7,168,652 | B2 * | 1/2007 | Tokunaga | 242/563 |
| 2011/0079675 | A1 * | 4/2011 | Iwatsuki et al. | 242/397 |

* cited by examiner

*Primary Examiner* — Sang Kim
(74) *Attorney, Agent, or Firm* — Winston Hsu; Scott Margo

(57) ABSTRACT

The present invention discloses a paper roll device including a casing, a cover connected to the casing, a moving component, a first resilient component connected to the moving component, a lever pivoted to the moving component, a second resilient component, a detecting module and a control module. The first resilient component is for driving the moving component to move in a first direction. The lever pivots relative to the moving component as the moving component moves. The second resilient component is connected to a sensing portion of the lever and for supporting the lever in the first direction. The detecting module is for detecting a position state of the sensing portion of the lever, so as to generate a corresponding detecting signal. The control module is for determining an open/closed state of the cover relative to the casing according to the detecting signal.

20 Claims, 11 Drawing Sheets

PAPER ROLL DEVICE CAPABLE OF DETECTING AN OPEN/CLOSED STATE OF A COVER

BACKGROUND OF THE INVENTION

1. Field of the Invention

The present invention relates to a paper roll device, and more specifically, to a paper roll device capable of detecting an open/closed state of a cover and indicating an amount of a paper roll automatically.

2. Description of the Prior Art

A conventional paper roll device, such as a lottery machine, a receipt machine or an ATM machine, often does not have a function of detecting whether a cover covers a casing and whether a paper roll is installed inside the casing of the machine. For ensuring that the paper roll is installed inside the casing, a user has to open the cover to check. Therefore, the user may easily forget to cover the casing or may not place the cover correctly. On the other way, if the cover is designed to be transparent, the user can see through the transparent cover to check whether the paper roll is installed inside the casing. But the user cannot be aware whether the paper roll is installed inside the casing and be aware of other related information immediately. Therefore, it is an important issue to design a paper roll device capable of notifying the user that whether the cover covers the casing correctly and whether the paper roll is installed inside the casing automatically.

SUMMARY OF THE INVENTION

The present invention is to provide a paper roll device having functions of detecting an open/closed state of a cover and notifying the user of an amount of a paper roll of the paper roll device automatically, to solve above problems.

According to the disclosure, the paper roll device includes a casing, a cover, a moving component, a first resilient component, a lever, a second resilient component, a detecting module and a control module. The cover is connected to the casing and for covering the casing. The moving component is movably installed inside the casing. The first resilient component is installed inside the casing and connected to an end of the moving component, and the first resilient component is for driving the moving component to move in a first direction. The lever is installed inside the casing. An end of the lever is pivoted to the end of the moving component, and the lever pivots relative to the moving component as the moving component moves. The second resilient component is connected to a sensing portion of the lever and for supporting the lever in an initial position in the first direction. The detecting module is installed inside the casing, and the detecting module is for detecting a position state of the sensing portion of the lever, so as to generate a corresponding detecting signal. The control module is installed inside the casing and electrically connected to the detecting module. The control module is for determining an open/closed state of the cover relative to the casing according to the detecting signal generated from the detecting module.

According to the disclosure, the detecting module is a switch unit, as the cover does not cover the casing, the first resilient component drives the moving component to move in the first direction, so that the other end of the moving component protrudes outside the casing, the second resilient component supports the lever in the initial position, the sensing portion does not actuate the detecting module, and the control module determines that the cover is at an open state according to the detecting signal.

According to the disclosure, the detecting module is a switch unit, as the cover covers the casing, the cover presses the moving component downward to move in a second direction opposite to the first direction, so as to drive the lever to pivot relative to the moving component, so that the sensing portion of the lever actuates the detecting module, and the control module determines that the cover is at a closed state according to the detecting signal.

According to the disclosure, the paper roll device further includes a storage module electrically connected to the control module for storing a set of predetermined detecting values, and the control module is further for determining the open/closed state of the paper roll device after comparing the set of predetermined detecting values with the detecting signal.

According to the disclosure, the detecting module includes a light emitter and a light receiver, the light emitter is for emitting a light beam, the light receiver generates the corresponding detecting signal according to a received light amount from the light emitter, and the control module compares the set of predetermined detecting values with the corresponding detecting signal, so as to determine the open/closed state of the paper roll device.

According to the disclosure, the light emitter and the light receiver are disposed on two opposite sides of the sensing portion of the lever respectively, the set of predetermined detecting values comprises an open value, as the cover does not cover the casing, the first resilient component drives the moving component to move in the first direction, so that the other end of the moving component protrudes outside the casing, the second resilient component supports the lever in the initial position, the sensing portion does not shade the light beam, the light receiver sends the corresponding detecting signal to the control module, and the control module determines that the cover is at an open state as the control module determines that the open value of the set of predetermined detecting values corresponds to the corresponding detecting signal.

According to the disclosure, the light emitter and the light receiver are disposed on two opposite sides of the sensing portion of the lever respectively, the set of predetermined detecting values comprises a closed value, as the cover covers the casing, the cover presses the moving component downward to move in a second direction opposite to the first direction, so as to drive the lever to pivot relative to the moving component, so that the sensing portion of the lever shades the light beam completely, the light receiver sends the corresponding detecting signal to the control module, and the control module determines that the cover is at a closed state as the control module determines that the closed value of the set of predetermined detecting values corresponds to the corresponding detecting signal.

According to the disclosure, the paper roll device further includes two rollers installed inside the casing for supporting a paper roll, the other end of the lever is disposed between the two rollers, and the control module is further for determining a using state of the paper roll according to the detecting signal generated from the detecting module.

According to the disclosure, the set of predetermined detecting values comprises an initial using value, as the paper roll pushes the other end of the lever in the second direction to pivot the lever in a pivoting direction relative to the moving component and the sensing portion shades a part of the light beam, the light receiver sends the corresponding detecting signal to the control module, and the control module determines that the using state is an initial using state as the control module determines that the initial using value of the set of predetermined detecting values corresponds to the corresponding detecting signal.

According to the disclosure, the set of predetermined detecting values further comprises an alert value, as a diameter of the paper roll is less than a predetermined diameter value, the paper roll continues to push the other end of the lever, so that the lever pivots in the pivoting direction relative to the moving component and the sensing portion shades a part of the light beam, the light receiver sends the corresponding detecting signal to the control module, and the control module determines that the using state is a low amount state as the control module determines that the alert value of the set of predetermined detecting values corresponds to the corresponding detecting signal.

According to the disclosure, the light emitter and the light receiver are disposed on a same side of the sensing portion of the lever, the set of predetermined detecting values comprises an open value, as the cover does not cover the casing, the first resilient component drives the moving component to move in the first direction, so that the other end of the moving component protrudes outside the casing, the second resilient component supports the lever in the initial position, the sensing portion does not reflect the light beam to the light receiver, the light receiver sends the corresponding detecting signal to the control module, and the control module determines that the cover is at an open state as the control module determines that the open value of the set of predetermined detecting values corresponds to the corresponding detecting signal.

According to the disclosure, the light emitter and the light receiver are disposed on a same side of the sensing portion of the lever, the set of predetermined detecting values comprises a closed value, as the cover covers the casing, the cover presses the moving component downward to move in a second direction opposite to the first direction, so as to drive the lever to pivot relative to the moving component, so that the sensing portion of the lever reflects the light beam to the light receiver completely, the light receiver sends the corresponding detecting signal to the control module, and the control module determines that cover is at a closed state as the control module determines that the closed value of the set of predetermined detecting values corresponds to the corresponding detecting signal.

According to the disclosure, the set of predetermined detecting values comprises an initial using value, as the paper roll pushes the other end of the lever in the second direction to pivot the lever in a pivoting direction relative to the moving component and the sensing portion reflects a part of the light beam, the light receiver sends the corresponding detecting signal to the control module, and the control module determines that the using state is an initial using state as the control module determines that the initial using value of the set of predetermined detecting values corresponds to the corresponding detecting signal.

According to the disclosure, the set of predetermined detecting values further comprises an alert value, as a diameter of the paper roll is less than a predetermined diameter value, the paper roll pushes the other end of the lever in the second direction, so that the lever pivots in the pivoting direction relative to the moving component and the sensing portion reflects a part of the light beam, the light receiver sends the corresponding detecting signal to the control module, and the control module determines that the using state is a low amount state as the control module determines that the alert value of the set of predetermined detecting values corresponds to the corresponding detecting signal.

According to the disclosure, the paper roll device further includes a state notification module electrically connected to the control module, and the control module is further for controlling the state notification module to generate a corresponding notification message according to the using state.

According to the disclosure, the paper roll device further includes a state notification module electrically connected to the control module, and the control module is further for controlling the state notification module to generate a corresponding notification message according to the open/closed state.

The paper roll device of the present invention has functions of detecting whether the cover covers the casing and detecting the amount of the paper roll. The state notification module of the present invention can notify the user of the open/closed state of the cover and the using state of the paper roll by sound, text message or light, so that it can prevent the user from using the paper roll device accidentally as the cover is open, and the user can be aware of various states of the paper roll device without opening the cover. Therefore, it solves the conventional problems that the user has to open the cover to check whether the paper roll is installed inside the casing and the user may often forget to cover the casing easily or the cover is not placed correctly. In addition, the control module can determine the using state of the paper roll according to the detecting signal transmitted from the detecting module, and then the control module controls the state notification module to notify the user of the using state of the paper roll.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
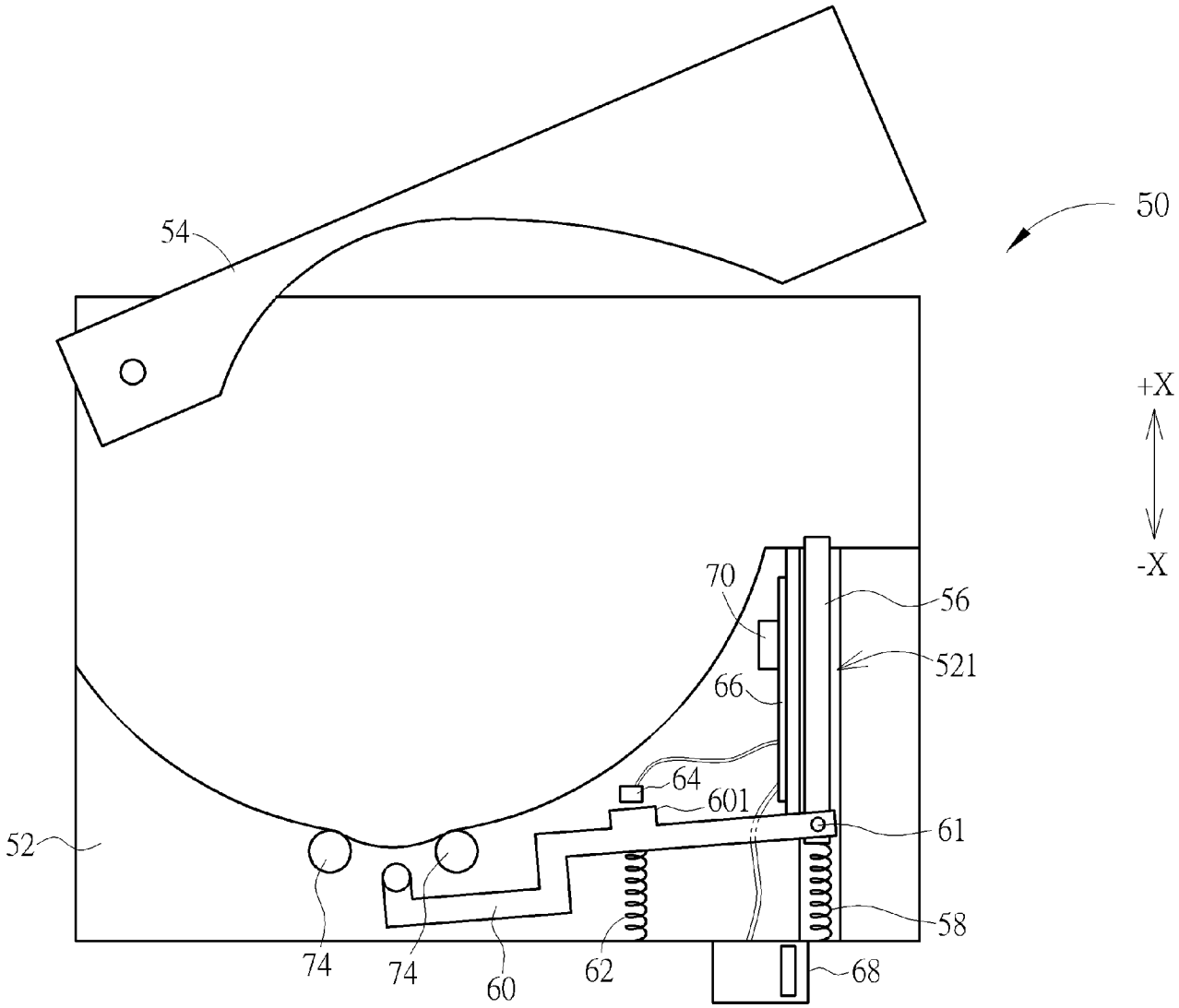
FIG. 1 and FIG. 2 are diagrams of a paper roll device in an open state and in a closed state according to an embodiment of the present invention.
Figure 2:
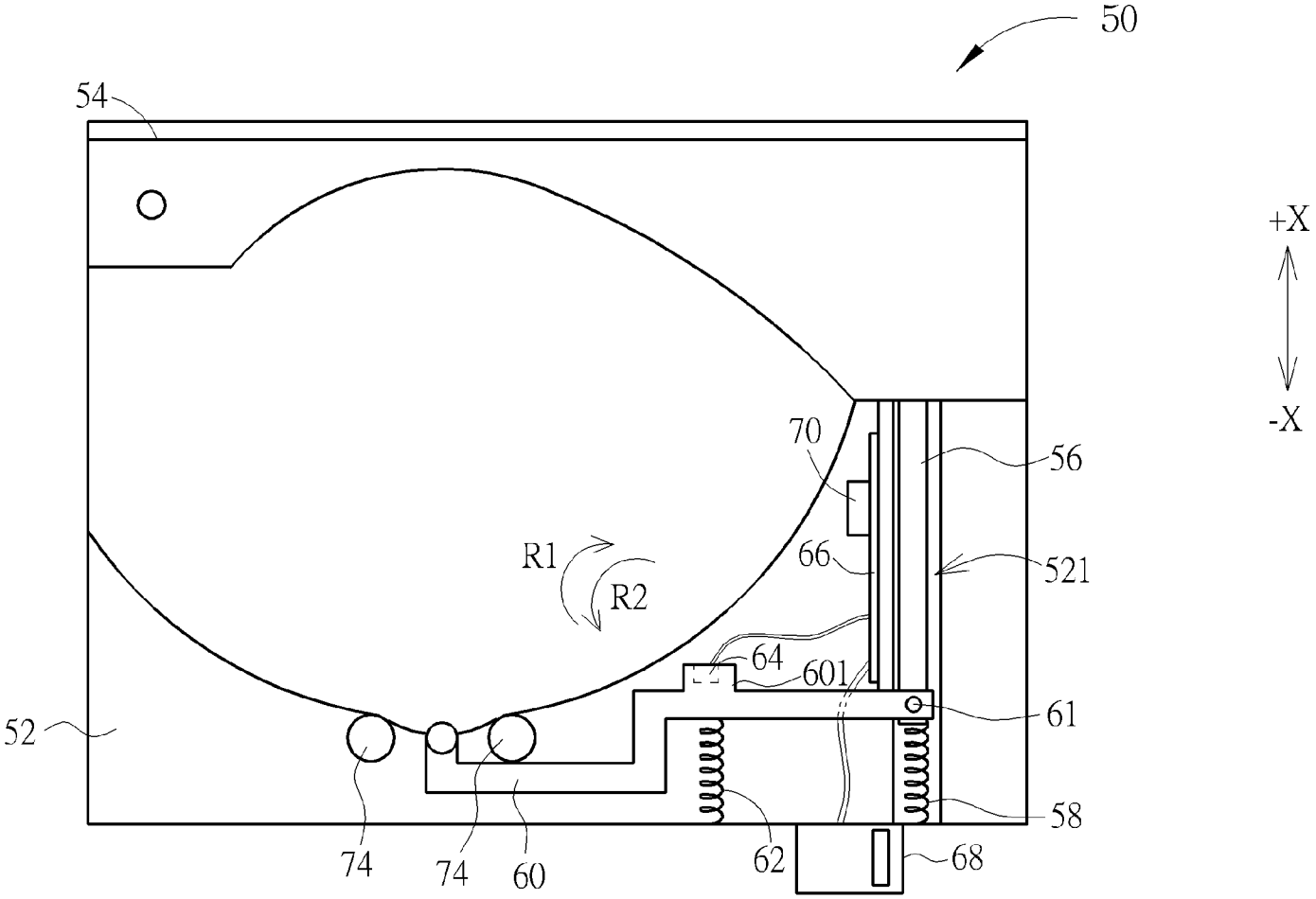

Please refer to FIG. 1 and FIG. 2. FIG. 1 and FIG. 2 are diagrams of a paper roll device 50 in an open state and in a closed state according to an embodiment of the present invention. The paper roll device 50 of the present invention can be applied to various automatic paper ejecting devices, such as an ATM machine of a bank, a receipt printer of a convenient store, or a lottery machine of a lottery store or a game store. The paper roll device 50 of the present invention has a function of detecting an open/closed state of a cover, and the paper roll device 50 includes a casing 52, a cover 54, a moving component 56, a first resilient component 58, a lever 60 and a second resilient component 62. The cover 54 is connected to the casing 52 and for covering the casing 52, as shown in FIG. 2. The moving component 56 is movably installed inside a space 521 of the casing 52. The first resilient component 58 is installed inside the space 521 of the casing 52 and connected to an end of the moving component 56, and the first resilient component 58 is for driving the moving component 56 to move in a first direction (+X direction). As shown in FIG. 1, as the cover 54 does not cover the casing 52, the first resilient component 58 provides a resilient force to drive the moving component 56 in the first direction (+X direction), so that the other end of the moving component 56 protrudes outside the space 521 of the casing 52. The lever 60 is installed inside the casing 52. An end of the lever 60 is pivoted to the end of the moving component 56 via a pivoting point 61, and the lever 60 pivots relative to the moving component 56 as the moving component 56 moves. The second resilient component 62 is connected to a sensing portion 601 of the lever 60 and for supporting the lever 60 in an initial position in the first direction (+X direction).

Please refer to FIG. 1 and FIG. 2. The paper roll device 50 of the present invention further includes a detecting module 64 and a control module 66. The detecting module 64 is installed inside the casing 52, and the detecting module 64 is for detecting a position state of the sensing portion 601 of the lever 60, so as to generate a corresponding detecting signal. The control module 66 is installed inside the casing 52 and electrically connected to the detecting module 64. The control module 66 is for determining the open/closed state of the cover 54 relative to the casing 52 according to the detecting signal generated from the detecting module 64. For example, the detecting module 64 can be a switch unit. As shown in FIG. 1, as the cover 54 does not cover the casing 52, the first resilient component 58 provides the resilient force to drive the moving component 56 to move in the first direction (+X direction), so that the other end of the moving component 56 protrudes outside the space 521 of the casing 52. At this time, the second resilient component 62 supports the lever 60 in the initial position, and the sensing portion 601 does not actuate the switch unit, so that the control module 66 determines that the cover 54 is at an open state according to the detecting signal. In addition, as shown in FIG. 2, as the cover 54 covers the casing 52, the cover 54 presses the moving component 56 downward to move in a second direction (−X direction) opposite to the first direction (+X direction), so as to drive the lever 60 to pivot relative to the moving component 56 in a pivoting direction R1 around the pivoting point 61, so that the sensing portion 601 of the lever 60 actuates the switch unit. At this time, the control module 66 determines that the cover 54 is at a closed state according to the detecting signal. In this embodiment, the detecting signal generated from the detecting module 64 can be an ON\OFF signal. As the sensing portion 601 does not actuate the switch unit, the detecting module 64 can be designed to send an ON signal to the control module 66, so that the control module 66 determines that the cover 54 is at the open state according to the ON signal. On the contrary, as the sensing portion 601 actuates the switch unit, the detecting module 64 can be designed to send the OFF signal to the control module 66, so that the control module 66 determines that the cover 54 is at the closed state according to the OFF signal.

Besides, according to another embodiment, as the sensing portion 601 does not actuate the switch unit, the detecting module 64 can be designed to send the OFF signal to the control module 66, so that the control module 66 determines that the cover 54 is at the open state according to the OFF signal. On the contrary, as the sensing portion 601 actuates the switch unit, the detecting module 64 can be designed to send the ON signal to the control module 66, so that the control module 66 determines that the cover 54 is at the closed state according to the ON signal.

In addition, the paper roll device 50 of the present invention can further include a state notification module 68 electrically connected to the control module 66, and the control module 66 is further for controlling the state notification module 68 to generate a corresponding notification message to notify a user according to the open/closed state of the cover 54. The state notification module 68 can be a sound module, a light-emitting module or a text message module. That is, the state notification module 68 can notify the user of the open/closed state of the cover 54 of the paper roll device 50 by sound, light or text messages.

Figure 3:
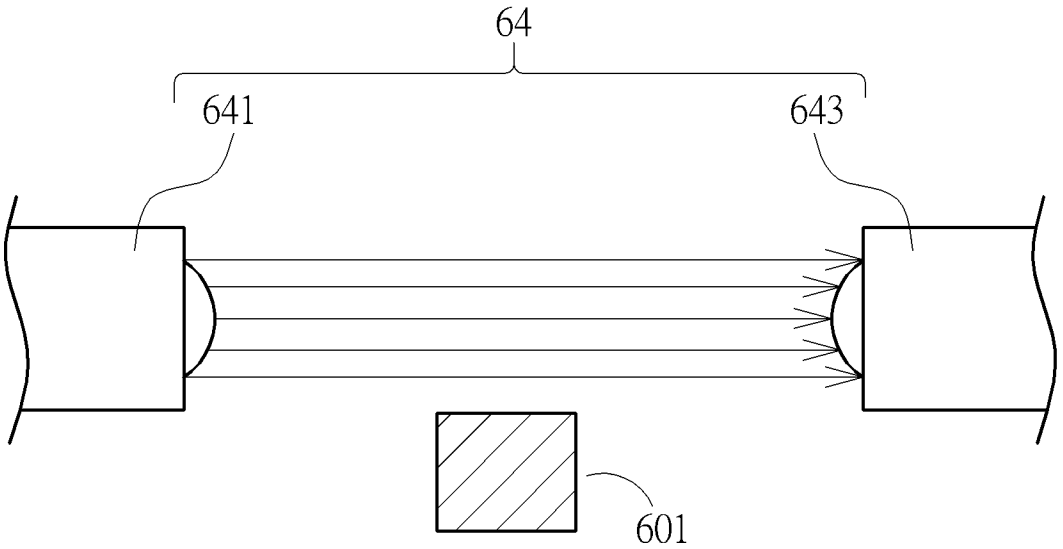
FIG. 3 and FIG. 4 are diagrams illustrating that a sensing portion in different positions relative to a detecting module according to the embodiment of the present invention.
Figure 4:
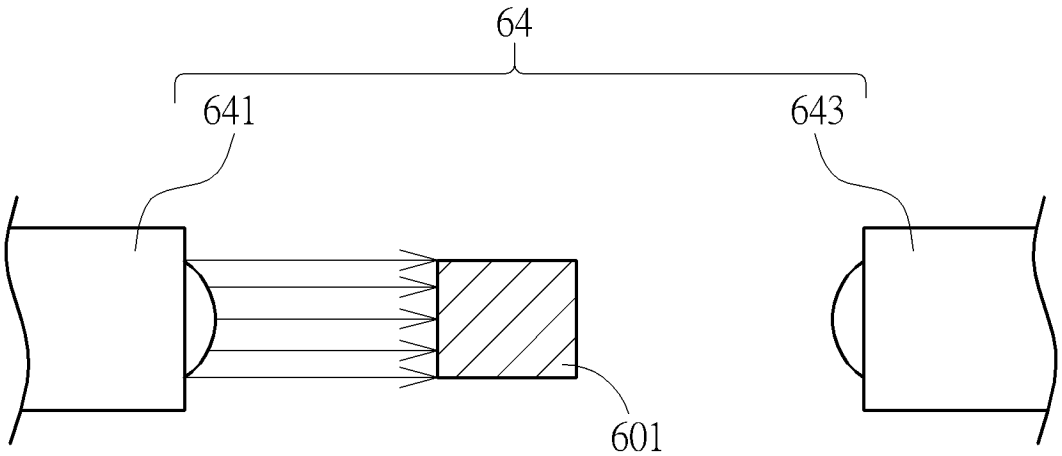

Please refer to FIG. 1 to FIG. 4. FIG. 3 and FIG. 4 are diagrams illustrating that the sensing portion 601 in different positions relative to the detecting module 64 according to the embodiment of the present invention. As shown in FIG. 1, the paper roll device 50 of the present invention can further include a storage module 70 electrically connected to the control module 66 for storing a set of predetermined detecting values, and the set of predetermined detecting values can include an open value and a closed value. The control module 66 is further for determining the open/closed state of the paper roll device 50 after comparing the set of predetermined detecting values with the detecting signal. As shown in FIG. 3 and FIG. 4, the detecting module 64 can include a light emitter 641 and a light receiver 643. The light emitter 641 is for emitting a light beam, and the light receiver 643 generates the corresponding detecting signal according to a received light amount from the light emitter 641. The control module 66 compares the set of predetermined detecting values with the corresponding detecting signal, so as to determine the open/closed state of the paper roll device 50.

In this embodiment, the light emitter 641 and the light receiver 643 are disposed on two opposite sides of the sensing portion 601 of the lever 60 respectively. That is, the detecting module 64 can be an interruptive sensor. As shown in FIG. 1, as the cover 54 does not cover the casing 52, the first resilient component 58 drives the moving component 56 to move in the first direction (+X direction), so that the other end of the moving component 56 protrudes outside the space 521 of the casing 52. At this time, the second resilient component 62 supports the lever 60 in the initial position, and the sensing portion 601 does not shade the light beam. The light receiver 643 sends the corresponding detecting signal to the control module 66 after receiving the corresponding detecting signal, and the control module 66 determines that the cover 54 is at the open state as the control module 66 determines that the open value of the set of predetermined detecting values corresponds to the corresponding detecting signal. As shown in FIG. 2, as the cover 54 covers the casing 52, the cover 54 presses the moving component 56 downward to move in the second direction (−X direction), so as to drive the lever 60 to pivot relative to the moving component 56, so that the sensing portion 601 of the lever 60 shades the light beam completely, as shown in FIG. 4. At this time, the light receiver 643 does not receive the light beam and sends the corresponding detecting signal to the control module 66, and the control module 66 determines that the cover 54 is at the closed state as the control module 66 determines that the closed value of the set of predetermined detecting values corresponds to the corresponding detecting signal.

Figure 5:
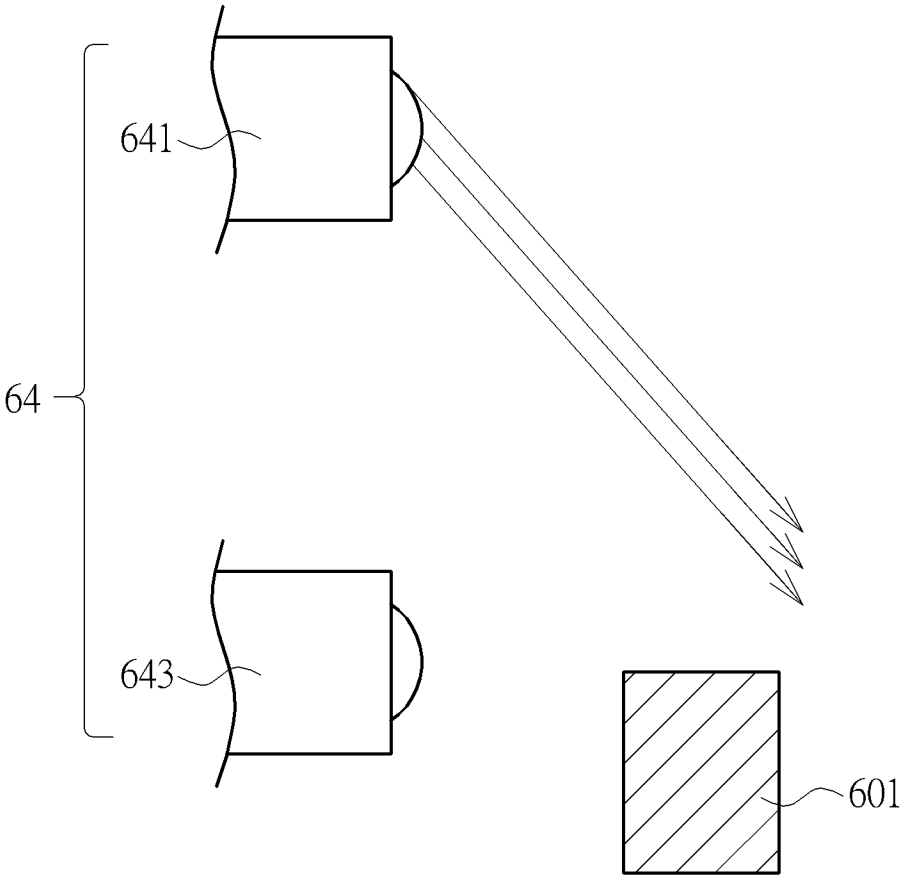
FIG. 5 and FIG. 6 are diagrams illustrating that a light emitter and a light receiver are disposed on a same side of the sensing portion according to another embodiment of the present invention.
Figure 6:
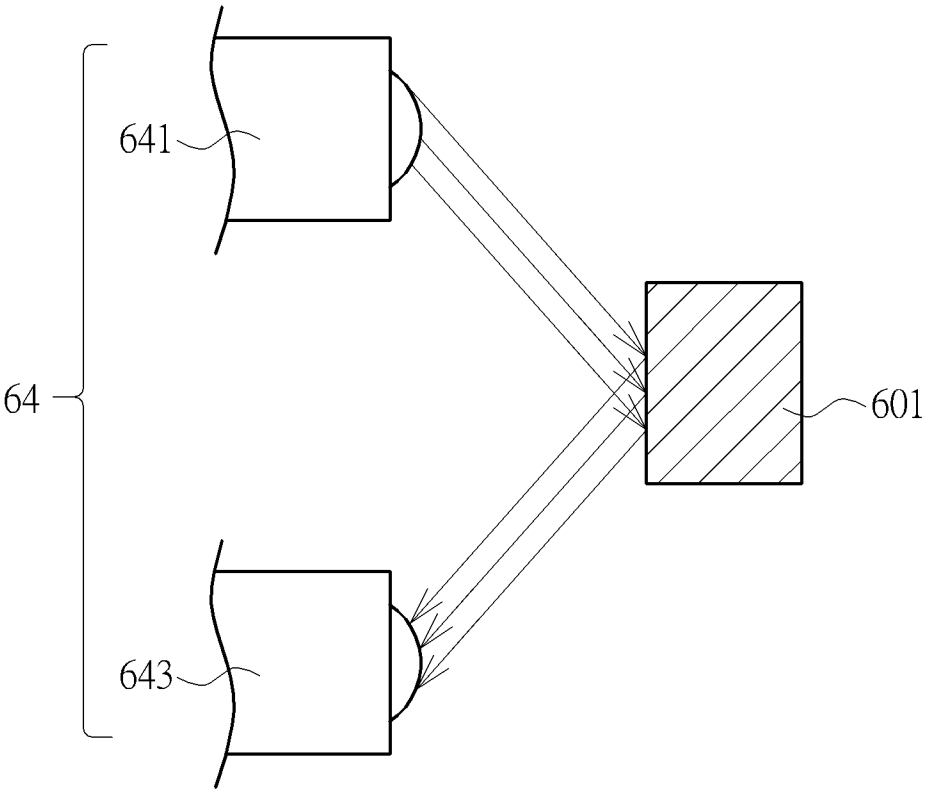

Please refer to FIG. 1, FIG. 2 and FIG. 5 to FIG. 6. FIG. 5 and FIG. 6 are diagrams illustrating that the light emitter 641 and the light receiver 643 are disposed on a same side of the sensing portion 601 according to another embodiment of the present invention. That is, the detecting module 64 can be a reflective sensor. In this embodiment, the light emitter 641 and the light receiver 643 are disposed on the same side of the sensing portion 601. As shown in FIG. 1, as the cover 54 does not cover the casing 52, the sensing portion 601 does not reflect the light beam to the light receiver 643. At this time, the light receiver 643 sends the corresponding detecting signal to the control module 66, and the control module 66 determines that the cover 54 is at the open state as the control module 66 determines that the open value of the set of predetermined detecting values corresponds to the corresponding detecting signal. As shown in FIG. 2, as the cover 54 covers the casing 52, the sensing portion 601 reflects the light beam to the light receiver 643 completely. At this time, the light receiver 643 sends the corresponding detecting signal to the control module 66, and the control module 66 determines that cover 54 is at the closed state as the control module 66 determines that the closed value of the set of predetermined detecting values corresponds to the corresponding detecting signal.

Figure 7:
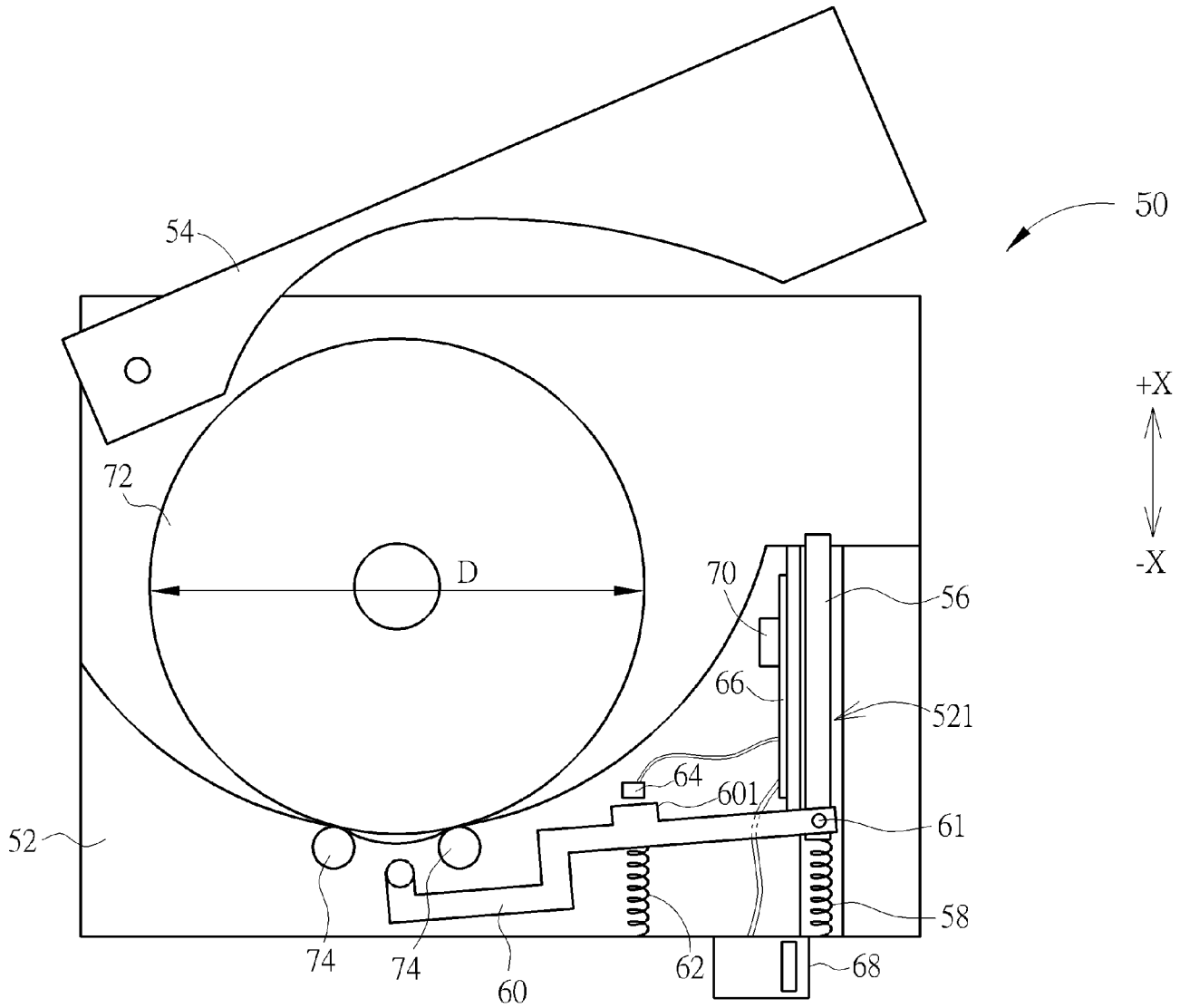
FIG. 7 is a diagram illustrating that a paper roll is installed inside a casing according to the embodiment of the present invention.

Please refer to FIG. 1, FIG. 2 and FIG. 7. FIG. 7 is a diagram illustrating that a paper roll 72 is installed inside the casing 52 according to the embodiment of the present invention. The paper roll device 50 further includes two rollers 74 installed inside the casing 52. As shown in FIG. 7, as the cover 54 does not cover the casing 52, the lever 60 is not disposed horizontally as shown in FIG. 2 substantially, so that the two rollers 74 do not contact against the other end of the lever 60, and the control module 66 determines the cover 54 is at the open state at this time as mentioned above. That is, as the cover 54 does not cover the casing 52, the control module 66 can determines the open/closed state correctly no matter whether the paper roll 72 is installed inside the casing 52.

Figure 8:
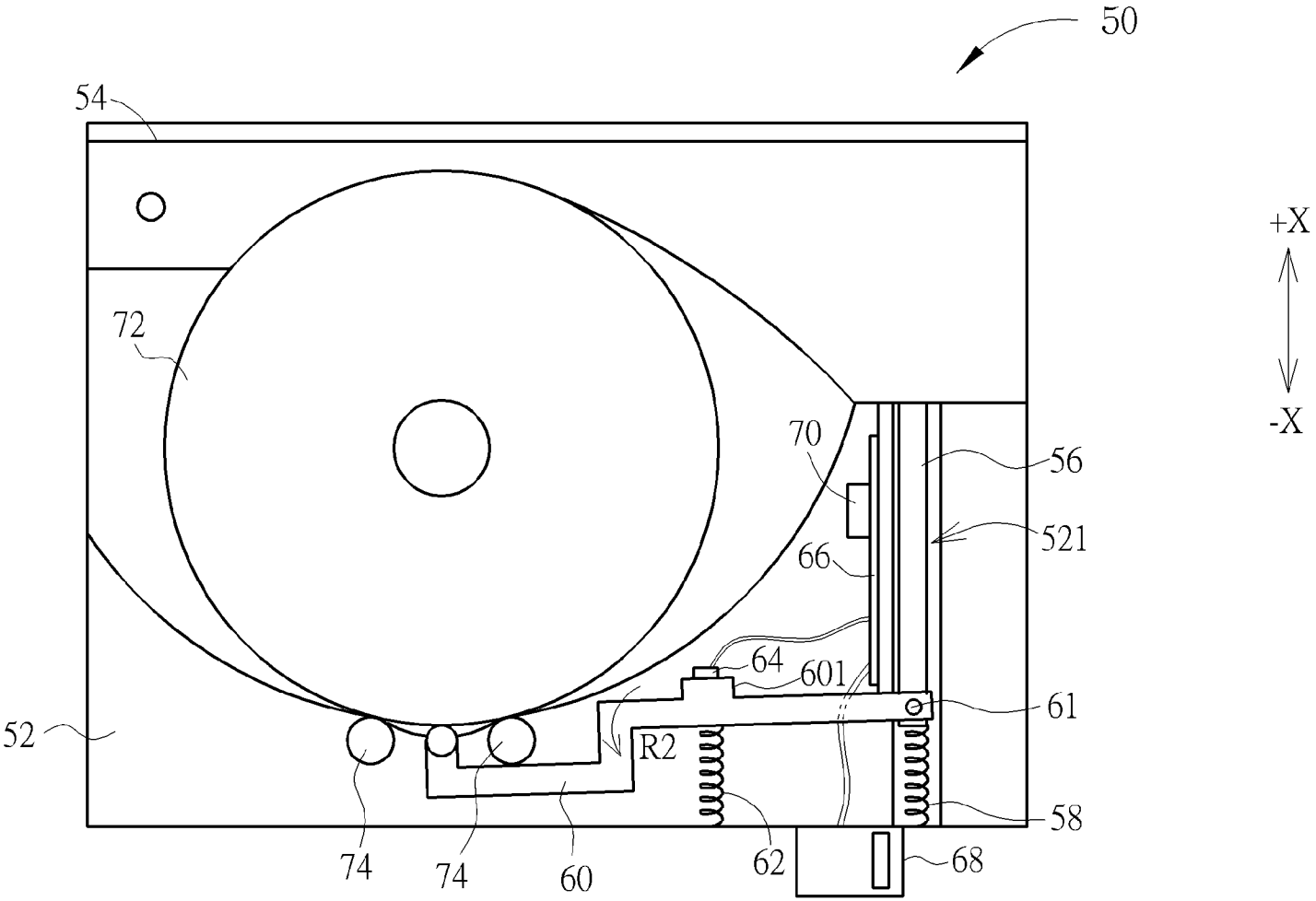
FIG. 8 and FIG. 9 are diagrams of the paper roll in different using states according to the embodiment of the present invention.
Figure 9:
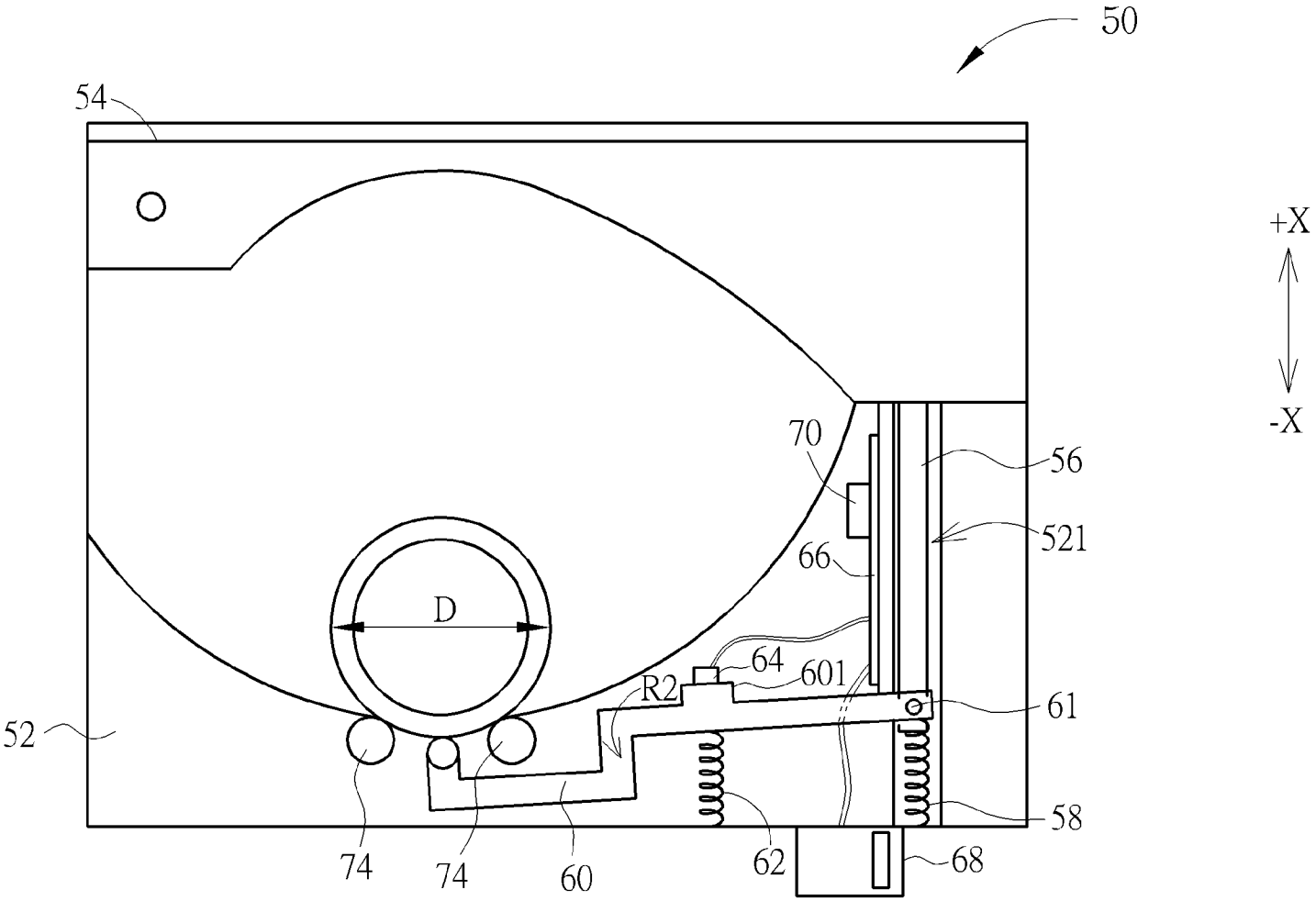
Figure 10:
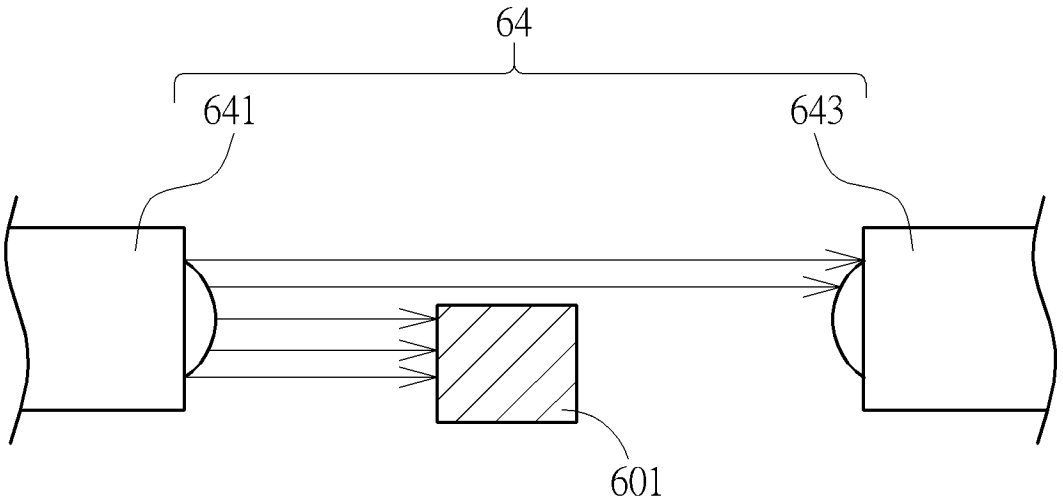
FIG. 10 and FIG. 11 are diagrams illustrating that the sensing portion is in different positions relative to the detecting module according to the embodiment of the present invention.
Figure 11:
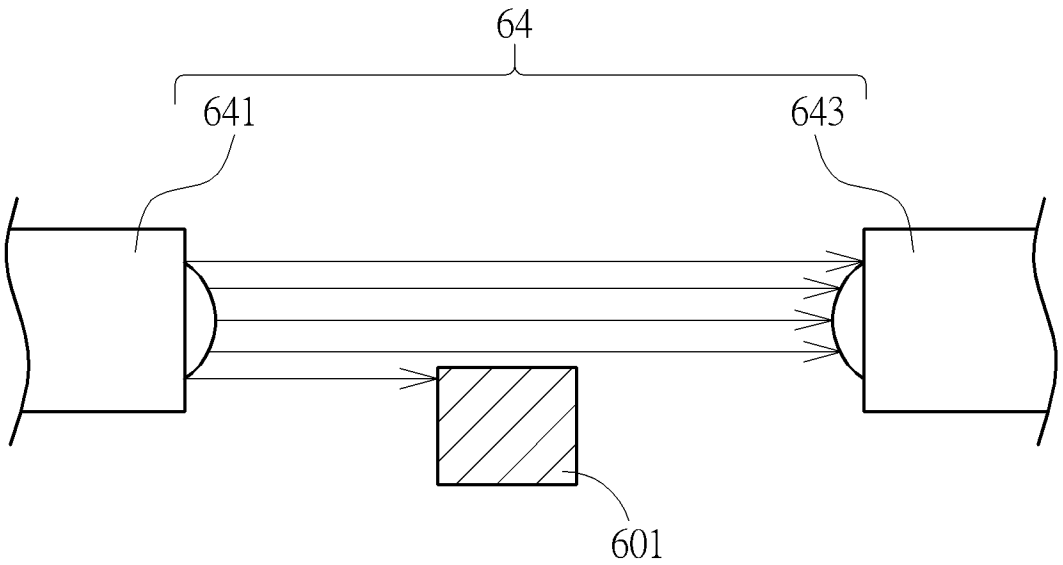

Please refer to FIG. 8 to FIG. 11. FIG. 8 and FIG. 9 are diagrams of the paper roll 72 in different using states according to the embodiment of the present invention. FIG. 10 and FIG. 11 are diagrams illustrating that the sensing portion 601 is in different positions relative to the detecting module 64 according to the embodiment of the present invention. The paper roll device 50 of the present invention can further have a function of detecting an amount of the paper roll 72. As shown in FIG. 8 and FIG. 9, the other end of the lever 60 is disposed between the two rollers 74, and the two rollers 74 are for supporting the paper roll 72 cooperatively. The control module 66 is further for determining a using state of the paper roll 72 according to the detecting signal generated from the detecting module 64. In this embodiment, the control module 66 can be further designed to determine the using state of the paper roll 72 according to the detecting signal generated from the detecting module 64 after the cover 54 covers the casing 52. That is, when the control module 66 determines that the cover 54 is at the closed state after the control module 66 determines that the closed value of the set of predetermined detecting values corresponds to the corresponding detecting signal, the function of detecting the using state of the paper roll 72 is actuated.

As shown in FIG. 8, the cover 54 covers the casing 52 and the paper roll 72 contacts against the other end of the lever 60. In this embodiment, the detecting module 64 can be designed to be composed of the light emitter 641 and the light receiver 643, and the light emitter 641 and the light receiver 643 are disposed on the two opposite sides of the sensing portion 601, but are not limited to it. For example, the light emitter 641 and the light receiver 643 can also be disposed on the same side of the sensing portion 601. The set of predetermined detecting values in the storage module 70 further includes an initial using value IV. As the cover 54 covers the casing 52 and the paper roll 72 installed inside the casing pushes the other end of the lever 60 in the second direction (−X direction), the lever 60 can be pivoted in a pivoting direction R2 opposite to the pivoting direction R1 relative to the moving component 56. At this time, as shown in FIG. 10, the sensing portion 601 shades a part of the light beam, and then the light receiver 643 sends the corresponding detecting signal to the control module 66, and the control module 66 determines that the using state of the paper roll 72 is an initial using state as the control module 66 determines that the initial using value IV of the set of predetermined detecting values corresponds to the corresponding detecting signal.

As shown in FIG. 9, the set of predetermined detecting values can further include an alert value AV, and as a diameter D of the paper roll 72 is less than a predetermined diameter value PD, the paper roll 72 continues to push the other end of the lever 60 in the second direction (−X direction), so that the lever 60 continues to pivot in the pivoting direction R2 relative to the moving component 56. At this time, as shown in FIG. 11, the sensing portion 601 shades less part of the light beam than the part of the light beam in FIG. 10, and the light receiver 643 sends the corresponding detecting signal to the control module 66. The control module 66 determines that the using state is a low amount state as the control module 66 determines that the alert value AV of the set of predetermined detecting values corresponds to the corresponding detecting signal. Furthermore, the control module 66 can control the state notification module 68 to generate the corresponding notification message to notify the user of a remaining amount of the paper roll 72 according to different using states of the paper roll 72.

It is noticed that the detecting module 64 of the present invention is not limited to the interruptive sensor in FIG. 3 and FIG. 4 or the reflective sensor in FIG. 5 and FIG. 6. Detectors capable of detecting variations of the position of the sensing portion 601 of the lever 60 are within the scope of the present invention. Furthermore, the detecting signal generated by the detectors in FIG. 3 to FIG. 6 can be a continuous analog signal which corresponds to variation of the light quantity of the light beam received by the light receiver. That is, the detecting signal corresponds to the continuous variation of the position of the sensing portion 601, and the control module 66 can convert the continuous detecting signal into a corresponding digital signal. Then, the control module 66 compares the corresponding digital signal and the set of predetermined detecting values stored in the storage module 70, so as to present a continuous variation of the remaining amount of the paper roll 72 effectively. Furthermore, the control module 66 controls the state notification module 68 to generate the corresponding notification messages to notify the user of the using state of the paper roll 72 according to the using state. For example, the control module 66 can convert the detecting signal into the corresponding digital signal and control the state notification module 68 to display a percentage of the remaining amount of the paper roll 72 according to the digital signal, so that the user is able to be aware of the amount of the paper roll 72.

In contrast to the prior art, the paper roll device of the present invention has functions of detecting whether the cover covers the casing and detecting the amount of the paper roll. The state notification module of the present invention can notify the user of the open/closed state of the cover and the using state of the paper roll by sound, text message or light, so that it can prevent the user from using the paper roll device accidentally as the cover is open, and the user can be aware of various states of the paper roll device without opening the cover. Therefore, it solves the conventional problems that the user has to open the cover to check whether the paper roll is installed inside the casing and the user may often forget to cover the casing easily or the cover is not placed correctly. In addition, the control module can determine the using state of the paper roll according to the detecting signal transmitted from the detecting module, and then the control module controls the state notification module to notify the user of the using state of the paper roll.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A paper roll device, comprising:

a casing;

a cover connected to the casing and for covering the casing;

a moving component movably installed inside the casing;

a first resilient component installed inside the casing and connected to an end of the moving component, the first resilient component being for driving the moving component to move in a first direction;

a lever installed inside the casing, an end of the lever being pivoted to the end of the moving component, and the lever pivoting relative to the moving component as the moving component moves;

a second resilient component connected to a sensing portion of the lever and for supporting the lever in an initial position in the first direction;

a detecting module installed inside the casing, the detecting module being for detecting a position state of the sensing portion of the lever, so as to generate a corresponding detecting signal; and a control module installed inside the casing and electrically connected to the detecting module, the control module being for determining an open/closed state of the cover relative to the casing according to the detecting signal generated from the detecting module.

2. The paper roll device of claim 1, wherein the detecting module is a switch unit, as the cover does not cover the casing, the first resilient component drives the moving component to move in the first direction, so that the other end of the moving component protrudes outside the casing, the second resilient component supports the lever in the initial position, the sensing portion does not actuate the detecting module, and the control module determines that the cover is at an open state according to the detecting signal.

3. The paper roll device of claim 1, wherein the detecting module is a switch unit, as the cover covers the casing, the cover presses the moving component downward to move in a second direction opposite to the first direction, so as to drive the lever to pivot relative to the moving component, so that the sensing portion of the lever actuates the detecting module, and the control module determines that the cover is at a closed state according to the detecting signal.

4. The paper roll device of claim 1, further comprising a storage module electrically connected to the control module for storing a set of predetermined detecting values, and the control module being further for determining the open/closed state of the paper roll device after comparing the set of predetermined detecting values with the detecting signal.

5. The paper roll device of claim 4, wherein the detecting module comprises a light emitter and a light receiver, the light emitter is for emitting a light beam, the light receiver generates the corresponding detecting signal according to a received light amount from the light emitter, and the control module compares the set of predetermined detecting values with the corresponding detecting signal, so as to determine the open/closed state of the paper roll device.

6. The paper roll device of claim 5, wherein the light emitter and the light receiver are disposed on two opposite sides of the sensing portion of the lever respectively, the set of predetermined detecting values comprises an open value, as the cover does not cover the casing, the first resilient component drives the moving component to move in the first direction, so that the other end of the moving component protrudes outside the casing, the second resilient component supports the lever in the initial position, the sensing portion does not shade the light beam, the light receiver sends the corresponding detecting signal to the control module, and the control module determines that the cover is at an open state as the control module determines that the open value of the set of predetermined detecting values corresponds to the corresponding detecting signal.

7. The paper roll device of claim 5, wherein the light emitter and the light receiver are disposed on two opposite sides of the sensing portion of the lever respectively, the set of predetermined detecting values comprises a closed value, as the cover covers the casing, the cover presses the moving component downward to move in a second direction opposite to the first direction, so as to drive the lever to pivot relative to the moving component, so that the sensing portion of the lever shades the light beam completely, the light receiver sends the corresponding detecting signal to the control module, and the control module determines that the cover is at a closed state as the control module determines that the closed value of the set of predetermined detecting values corresponds to the corresponding detecting signal.

8. The paper roll device of claim 7, further comprising two rollers installed inside the casing for supporting a paper roll, the other end of the lever being disposed between the two rollers, and the control module being further for determining a using state of the paper roll according to the detecting signal generated from the detecting module.

9. The paper roll device of claim 8, wherein the set of predetermined detecting values comprises an initial using value, as the paper roll pushes the other end of the lever in the second direction to pivot the lever in a pivoting direction relative to the moving component and the sensing portion shades a part of the light beam, the light receiver sends the corresponding detecting signal to the control module, and the control module determines that the using state is an initial using state as the control module determines that the initial using value of the set of predetermined detecting values corresponds to the corresponding detecting signal.

10. The paper roll device of claim 9, wherein the set of predetermined detecting values further comprises an alert value, as a diameter of the paper roll is less than a predetermined diameter value, the paper roll continues to push the other end of the lever, so that the lever pivots in the pivoting direction relative to the moving component and the sensing portion shades a part of the light beam, the light receiver sends the corresponding detecting signal to the control module, and the control module determines that the using state is a low amount state as the control module determines that the alert value of the set of predetermined detecting values corresponds to the corresponding detecting signal.

11. The paper roll device of claim 5, wherein the light emitter and the light receiver are disposed on a same side of the sensing portion of the lever, the set of predetermined detecting values comprises an open value, as the cover does not cover the casing, the first resilient component drives the moving component to move in the first direction, so that the other end of the moving component protrudes outside the casing, the second resilient component supports the lever in the initial position, the sensing portion does not reflect the light beam to the light receiver, the light receiver sends the corresponding detecting signal to the control module, and the control module determines that the cover is at an open state as the control module determines that the open value of the set of predetermined detecting values corresponds to the corresponding detecting signal.

12. The paper roll device of claim 5, wherein the light emitter and the light receiver are disposed on a same side of the sensing portion of the lever, the set of predetermined detecting values comprises a closed value, as the cover covers the casing, the cover presses the moving component downward to move in a second direction opposite to the first direction, so as to drive the lever to pivot relative to the moving component, so that the sensing portion of the lever reflects the light beam to the light receiver completely, the light receiver sends the corresponding detecting signal to the control module, and the control module determines that cover is at a closed state as the control module determines that the closed value of the set of predetermined detecting values corresponds to the corresponding detecting signal.

13. The paper roll device of claim 12, further comprising two rollers installed inside the casing for supporting a paper roll, the other end of the lever being disposed between the two rollers, and the control module being further for determining a using state of the paper roll according to the detecting signal generated from the detecting module.

14. The paper roll device of claim 13, wherein the set of predetermined detecting values comprises an initial using value, as the paper roll pushes the other end of the lever in the second direction to pivot the lever in a pivoting direction relative to the moving component and the sensing portion reflects a part of the light beam, the light receiver sends the corresponding detecting signal to the control module, and the control module determines that the using state is an initial using state as the control module determines that the initial using value of the set of predetermined detecting values corresponds to the corresponding detecting signal.

15. The paper roll device of claim 14, wherein the set of predetermined detecting values further comprises an alert value, as a diameter of the paper roll is less than a predetermined diameter value, the paper roll pushes the other end of the lever in the second direction, so that the lever pivots in the pivoting direction relative to the moving component and the sensing portion reflects a part of the light beam, the light receiver sends the corresponding detecting signal to the control module, and the control module determines that the using state is a low amount state as the control module determines that the alert value of the set of predetermined detecting values corresponds to the corresponding detecting signal.

16. The paper roll device of claim 8, further comprising a state notification module electrically connected to the control module, and the control module being further for controlling the state notification module to generate a corresponding notification message according to the using state.

17. The paper roll device of claim 1, further comprising two rollers installed inside the casing for supporting a paper roll, the other end of the lever being disposed between the two rollers, and the control module being further for determining a using state of the paper roll according to the detecting signal generated from the detecting module after the cover covers the casing.

18. The paper roll device of claim 17, further comprising a storage module electrically connected to the control module for storing a set of predetermined detecting values, and the control module being further for determining the using state of the paper roll after comparing the set of predetermined detecting values with the detecting signal.

19. The paper roll device of claim 18, wherein the detecting module comprises a light emitter and a light receiver, the light emitter is for emitting a light beam, the light receiver generates the corresponding detecting signal according to a received light amount from the light emitter, and the control module compares the set of predetermined detecting values with the corresponding detecting signal, so as to determine the using state of the paper roll device.

20. The paper roll device of claim 1, further comprising a state notification module electrically connected to the control module, and the control module being further for controlling the state notification module to generate a corresponding notification message according to the open/closed state.

* * * * *